US010807259B2

(12) United States Patent
Bunnell

(10) Patent No.: US 10,807,259 B2
(45) **Date of Patent: *Oct. 20, 2020**

(54) UNIVERSAL RAZOR CARTRIDGE HANDLE

(71) Applicant: Edgewell Personal Care Brands, LLC., Chesterfield, MO (US)

(72) Inventor: Jay Bunnell, Orange, CT (US)

(73) Assignee: EDGEWELL PERSONAL CARE BRANDS, LLC, Chesterfield, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,762

(22) Filed: Mar. 14, 2018

(65) Prior Publication Data

US 2018/0200901 A1 Jul. 19, 2018

Related U.S. Application Data

(63) Continuation of application No. 14/877,999, filed on Oct. 8, 2015, now Pat. No. 9,999,981.

(60) Provisional application No. 62/062,221, filed on Oct. 10, 2014.

(51) Int. Cl.
*B26B 21/52* (2006.01)

(52) U.S. Cl.
CPC ..... *B26B 21/521* (2013.01)

(58) Field of Classification Search
CPC ..... B26B 21/00; B26B 21/02; B26B 21/14; B26B 21/16; B26B 21/22; B26B 21/225; B26B 21/52; B26B 21/521
USPC ..... D28/48; 30/34.1, 47–51, 526–535
See application file for complete search history.

(56) References Cited

U.S. PATENT DOCUMENTS

| | | | | |
|---|---|---|---|---|
| 4,198,746 A | | 4/1980 | Trotta | |
| 4,266,340 A | | 5/1981 | Bowman | |
| 4,339,876 A | * | 7/1982 | Davis | B26B 21/521 30/541 |
| 4,428,116 A | | 1/1984 | Chen | |
| 4,446,619 A | * | 5/1984 | Jacobson | B26B 21/521 30/47 |
| 4,461,078 A | * | 7/1984 | Carreker | B26B 21/523 30/47 |
| 4,501,066 A | * | 2/1985 | Sceberras | B26B 21/52 30/47 |

(Continued)

FOREIGN PATENT DOCUMENTS

| | | | | |
|---|---|---|---|---|
| EP | 3385043 A1 | * | 10/2018 | B26B 21/521 |
| WO | 2016057732 A1 | | 4/2016 | |

(Continued)

*Primary Examiner* — Jason Daniel Prone

(57) ABSTRACT

A safety razor handle in combination with a razor cartridge that is one of a first and second type razor cartridge, each with a respective connecting member, which first and second type razor cartridge connecting members are different from one another, is provided. The handle includes a cartridge end, a first assembly, a second assembly, and an ejector. The first assembly is configured to connect the first type razor cartridge's connecting member to a cartridge end of the handle. The second assembly is configured to connect the second type razor cartridge's connecting member to the cartridge end of the handle. The razor cartridge ejector is operable to selectively eject both first type razor cartridges and second type razor cartridges from the handle.

15 Claims, 11 Drawing Sheets

(56) References Cited

U.S. PATENT DOCUMENTS 4,989,328 A * 2/1991 Sokoloff ..... B26B 21/00 30/34.1
5,016,352 A 5/1991 Metcalf
5,027,511 A 7/1991 Miller
D319,893 S 9/1991 Pittaway
D327,550 S 6/1992 Chen
5,157,834 A 10/1992 Chen et al.
5,333,383 A 8/1994 Ferraro
5,347,717 A * 9/1994 Ts'ai ..... B26B 21/225 30/50
D352,689 S 11/1994 Niemier
D355,049 S 1/1995 Yasui
D363,142 S 10/1995 Shurtleff
D365,419 S 12/1995 Kamiya
D378,623 S 3/1997 Wonderley
5,669,139 A 9/1997 Oldroyd
D389,955 S 1/1998 Wonderley
D392,417 S 3/1998 Gray
5,784,790 A * 7/1998 Carson ..... B26B 21/225 30/532
D397,512 S 8/1998 Gray
5,787,586 A * 8/1998 Apprille, Jr. ..... B26B 21/225 30/47
D406,393 S 3/1999 Gray
D407,851 S 4/1999 Shurtleff
D408,101 S 4/1999 Shurtleff
5,890,296 A 4/1999 Metcalf
5,906,027 A * 5/1999 Barous ..... A46B 15/0055 30/51
5,953,824 A 9/1999 Ferraro
5,956,851 A * 9/1999 Apprille, Jr. ..... B26B 21/521 30/47
D417,034 S 11/1999 Shurtleff
6,052,905 A * 4/2000 Branchinelli ..... B26B 21/222 30/34.1
6,085,426 A 7/2000 Metcalf
D429,034 S 8/2000 Shurtleff
6,381,857 B1 5/2002 Oldroyd
6,425,184 B1 7/2002 Min
6,434,839 B1 8/2002 Lee
6,493,950 B1 12/2002 Kludjian
6,557,265 B2 5/2003 Coffin
6,560,876 B2 * 5/2003 Carr ..... B26B 21/222 30/34.1
6,560,881 B2 5/2003 Coffin
6,581,290 B1 * 6/2003 Fishel ..... B26B 21/222 30/50
6,612,040 B2 9/2003 Gilder
D495,828 S 9/2004 Ham
D510,643 S 10/2005 Gray
7,168,173 B2 * 1/2007 Worrick, III ..... B26B 21/222 30/527
7,219,430 B2 5/2007 Fandrey
7,461,458 B2 12/2008 Peyser
7,526,869 B2 5/2009 Blatter
7,574,809 B2 8/2009 Follo
7,685,720 B2 3/2010 Efthimiadis
7,770,294 B2 8/2010 Bruno
D624,701 S 9/2010 Jung
D651,345 S 12/2011 Micinilio
D652,991 S 1/2012 Cavazos Jimenez
D656,676 S 3/2012 Cavazos Jimenez
D656,677 S 3/2012 Cavazos Jimenez
8,230,600 B2 7/2012 Hart
D674,551 S 1/2013 Barrow
D674,552 S 1/2013 Barrow
D674,553 S 1/2013 Barrow
8,381,406 B2 2/2013 Miyazaki
8,474,144 B2 7/2013 Royle
8,590,162 B2 11/2013 Park
D695,960 S 12/2013 Floyd
D699,000 S 2/2014 Bae
D699,395 S 2/2014 Bae
D700,995 S 3/2014 Lee
D700,996 S 3/2014 Lee
8,683,701 B1 * 4/2014 Loftin ..... B26B 21/40 30/526
8,732,955 B2 5/2014 Howell
8,793,880 B2 * 8/2014 Taub ..... B26B 21/521 30/50
8,844,145 B2 9/2014 Psimadas
8,991,058 B2 3/2015 Dimitris
D749,267 S 2/2016 Leatherman
D768,929 S 10/2016 Go
D776,876 S 1/2017 Coviello
D778,499 S 2/2017 Dubin
D778,500 S 2/2017 Dubin
D779,122 S 2/2017 Dubin
D787,125 S 5/2017 Dubin
D787,126 S 5/2017 Dubin
D787,127 S 5/2017 Dubin
D789,609 S 6/2017 Kon
9,999,981 B2 * 6/2018 Bunnell ..... B26B 21/521
2003/0213130 A1 11/2003 Motta
2004/0181953 A1 9/2004 Follo
2004/0226178 A1 11/2004 Lukan
2006/0218804 A1 10/2006 Noble
2007/0283567 A1 * 12/2007 Magli ..... B26B 21/22 30/34.1
2008/0000089 A1 1/2008 Pennella
2008/0034589 A1 * 2/2008 Nearing ..... B26B 21/222 30/32
2008/0209733 A1 9/2008 Johnson
2009/0056139 A1 * 3/2009 Royle ..... B26B 21/40 30/34.05
2009/0119924 A1 5/2009 Bozikis
2009/0293292 A1 12/2009 Ramm
2010/0005669 A1 1/2010 Winter
2011/0041342 A1 * 2/2011 Starr ..... B26B 21/52 30/50
2011/0088269 A1 4/2011 Walker, Jr.
2012/0198698 A1 8/2012 Szczepanowski
2014/0116211 A1 5/2014 Griffin
2014/0230255 A1 8/2014 Stevens
2014/0230258 A1 8/2014 Eagleton
2014/0259679 A1 9/2014 Tracy
2015/0174776 A1 * 6/2015 Hawes ..... B26B 21/14 30/526
2015/0290819 A1 10/2015 Giannopoulos
2015/0328788 A1 11/2015 Ren
2016/0001455 A1 1/2016 Swenson
2017/0036363 A1 2/2017 Efthimiadis

FOREIGN PATENT DOCUMENTS

WO WO-2019046097 A1 * 3/2019 ..... B26B 21/521
WO WO-2019108392 A1 * 6/2019 ..... B26B 21/521

* cited by examiner

UNIVERSAL RAZOR CARTRIDGE HANDLE

CROSS REFERENCE TO RELATED APPLICATIONS

This application is a continuation of U.S. patent application Ser. No. 14/877,999, filed Oct. 8, 2015, now U.S. Pat. No. 9,999,981, which claims the benefit of U.S. provisional patent application Ser. No. 62/062,221, filed Oct. 10, 2014.

TECHNICAL FIELD

The present disclosure relates in general to safety razor handles, and in particular to safety razor handles for mounting disposable razor cartridges.

BACKGROUND INFORMATION

Many modern wet shaving razors, also known as safety razors, comprise a handle and a razor cartridge mounted to the handle. Some razors are so-called disposable razors wherein the handle and razor cartridge together are disposed of after use. Other razors can be in the form of a so-called system that comprises a handle that can be reused and a removable razor cartridge that is disposed of after use and can be replaced with a new cartridge.

Some system-type safety razors include a single point, plug and socket docking arrangement whereby a razor cartridge has a connecting member with a single recess or cavity portion adapted to receive a single extension or male projection of a cartridge end of a handle. U.S. Pat. Nos. 5,956,851 and 7,168,173 illustrate two such docking arrangements to mount the cartridge to the handle. As can be readily determined in these documents, each respective extension and recess are differently shaped such that for example a commercialized razor cartridge according to the '851 patent cannot be readily mounted to a commercialized handle according to the '173 patent. This can be disadvantageous to a user who might wish to sample certain shaving technologies that might only be offered together with one specific connecting member recess while the user only possesses a handle with an incompatible extension.

U.S. Pat. No. 8,793,880 discloses an adaptor sized to fit within a connecting member recess to effectively reduce dimensions of the recess such that a relatively smaller handle extension can be received within a relatively larger connecting member. This can permit a manufacturer to offer a sample of a new razor cartridge along with old razor cartridges at the point of sale. It is desirable to provide an adapter along with a new shaving razor cartridge design that enables consumer to try the new razor cartridge on an old and different shaving razor handle configuration.

SUMMARY OF THE DISCLOSURE

According to an aspect of the present disclosure, a razor cartridge handle configured to be connected to a first type razor cartridge, and configured to be connected to a second type razor cartridge, wherein the first type razor cartridge is different from the second type razor cartridge, is provided. The handle includes a cartridge end, a first assembly, a second assembly, an ejector button, an ejector, and a plunger. The first assembly is configured to connect the first type razor cartridge to the cartridge end of the handle. The second assembly is configured to connect the second type razor cartridge to the cartridge end of the handle. The first and second assemblies are configured so that only a single razor cartridge can be attached to the handle at a time. The ejector button is normally biased in a first position relative to the handle, and is translatable to an eject position. The ejector has a first arm with a distal end and a second arm with a distal end. The ejector is normally biased in a retracted position wherein the arms substantially reside within the handle. The ejector is in communication with the ejector button such that translating the ejector button to the eject position causes the ejector arms to extend outwardly from the handle cartridge end and causes the distal ends of the ejector arms to contact the attached razor cartridge. The plunger has a distal end. The plunger is normally biased outwardly from the handle cartridge end to reside in an extended position, wherein in the extended position the distal end of the plunger is in contact with the attached razor cartridge.

According to another aspect of the present disclosure, a razor cartridge handle configured to be connected to a first type razor cartridge, and configured to be connected to a second type razor cartridge, wherein the first type razor cartridge is different from the second type razor cartridge, is provided. The handle includes a cartridge end, a first assembly, a second assembly, an ejector, and a plunger. The first assembly is configured to connect the first type razor cartridge to a cartridge end of the handle. The second assembly is configured to connect the second type razor cartridge to the cartridge end of the handle. The first and second assemblies are configured so that only a single razor cartridge can be attached to the handle at a time. The razor cartridge ejector is operable to selectively eject both first type razor cartridges and second type razor cartridges. The plunger is normally biased to a position where a distal end of the plunger is in contact with the attached razor cartridge.

In a further embodiment of any of the above embodiments of the present razor cartridge handle, the first assembly includes a body extending outwardly from the cartridge end of the handle, which body is configured to be received within a connecting member of the first type razor cartridge. The body includes a top panel spaced apart from an opposing bottom panel, and an end panel extending between the top and bottom panels, and the bottom panel includes a pair of tab slots. The ejector includes a first arm with a distal end and a second arm with a distal end. At least a portion of the plunger and ejector arms are disposed between the top and bottom panels.

In a further embodiment of any of the above embodiments of the present razor cartridge handle, the second assembly includes a top locating panel spaced apart from the body top panel, and a bottom locating panel spaced apart from the body bottom panel.

In a further embodiment of any of the above embodiments of the present razor cartridge ha the second assembly further includes a wedge-shaped projection extending outwardly from the body end panel.

In a further embodiment of any of the above embodiments of the present razor cartridge handle, at least a portion of the wedge-shaped projection is disposed between the ejector arms when the ejector arms are extended outwardly from the handle cartridge end and the plunger is normally biased to extend outwardly from the wedge-shaped projection.

In a further embodiment of any of the above embodiments of the present razor cartridge handle, a distal end of the plunger is configured to engage a blade unit of an attached first type razor cartridge and configured to engage a surface of a blade unit of an attached second type razor cartridge.

In a further embodiment of any of the above embodiments of the present razor cartridge handle, the ejector includes a first arm with a distal end and a second arm with a distal end, and the distal ends of the ejector arms are configured to cooperate with a connecting member of an attached first type razor cartridge and configured to cooperate with a connecting member of an attached second type razor cartridge, to allow the attached razor cartridge to be removed from the present razor cartridge handle.

The features and advantages of the present disclosure will become apparent in light of the detailed description of the disclosure provided below, and as illustrated in the accompanying drawings.

DETAILED DESCRIPTION

Figure 1:
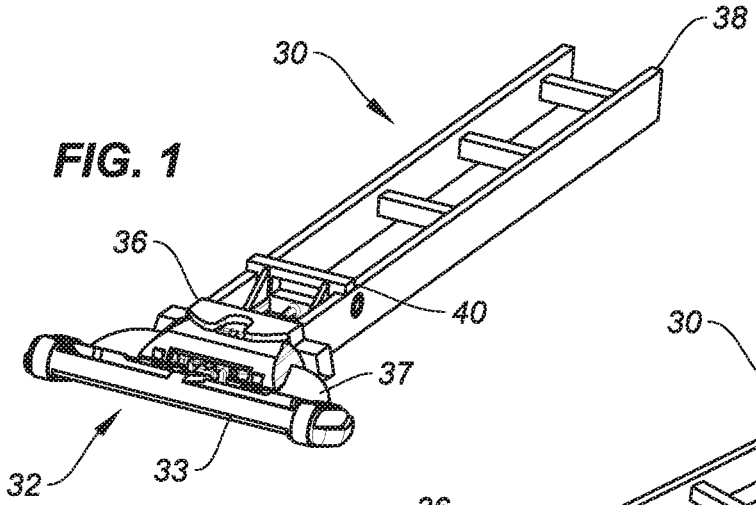
FIG. 1 is a diagrammatic perspective view of an embodiment of the present razor cartridge handle with a first type razor cartridge attached to the handle.
Figure 2:
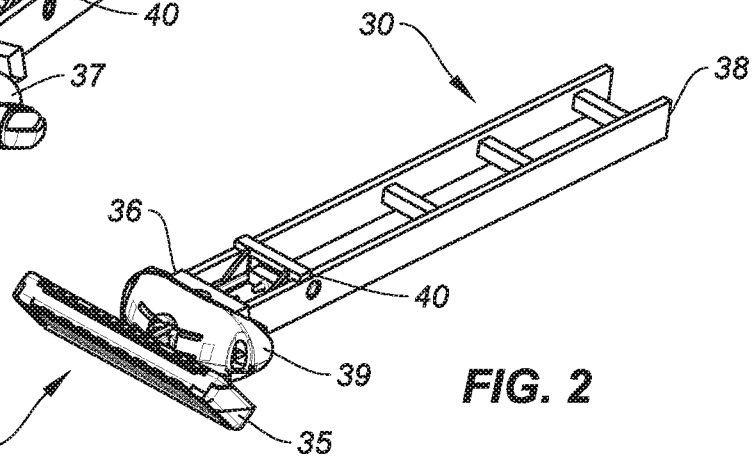
FIG. 2 is a diagrammatic perspective view of an embodiment of the present razor cartridge handle with a second type razor cartridge attached to the handle.

Referring to FIGS. 1 and 2, a razor cartridge handle (handle) 30 is provided. An example of a first type razor cartridge 32 is generally described in U.S. Pat. Nos. 5,787,586 and 5,956,851, which patents are hereby incorporated by reference in their entirety. An example of a second type razor cartridge 34 is described in U.S. Pat. No. 7,168,173, which patent is hereby incorporated by reference in its entirety. As will be described further below, both type razor cartridges 32, 34 include a blade unit (e.g., first type razor cartridge blade unit 33, second type razor cartridge blade unit 35) pivotally attached to a connecting member (e.g., first type razor cartridge connecting member 37, second type razor cartridge connecting member 39).

The razor cartridge handle 30 is configured to be connected to a plurality of different razor cartridge types, with only one razor cartridge of either type attached at a given time, with each razor cartridge type having a mechanism for attachment to the handle 30 that differs from the attachment mechanism of the other razor cartridge types as will be described below. The connecting member of each type of razor cartridge includes at least a portion of its attachment mechanism.

Referring to FIGS. 1-4, and 5A-5C, the razor cartridge handle 30 includes a cartridge end 36 and an opposed end 38. The razor cartridge handle 30 shown in FIGS. 1 and 2 and in FIGS. 3-5C are different embodiments of the present razor cartridge handle 30. The present razor cartridge handle 30 is not limited to either of these embodiments. Hereinafter, the term "razor cartridge handle" as used to describe the present disclosure will refer to both of these embodiments unless stated otherwise. The handle 30 can be curved to make the handle 30 ergonomically easy to hold (e.g., see FIGS. 3-5C), but is not limited to any particular shape configuration.

Figure 3:
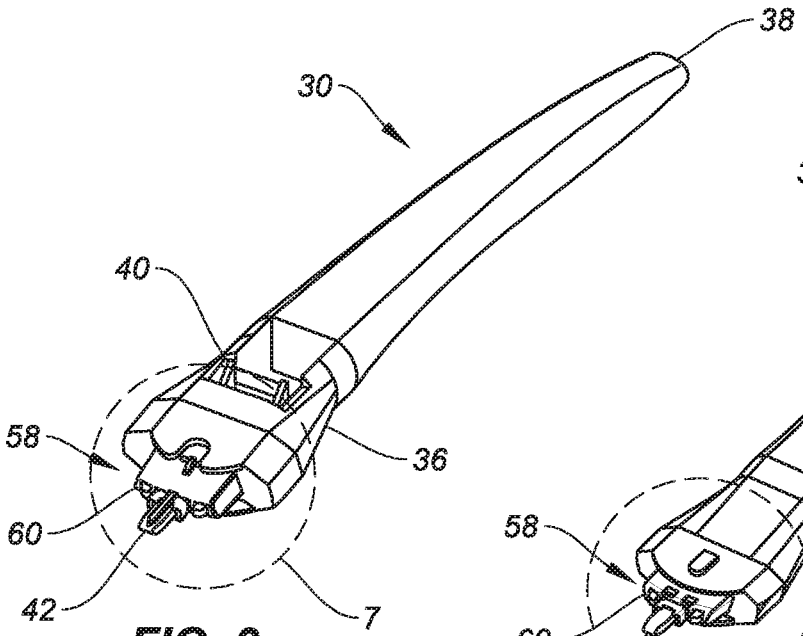
FIG. 3 is a diagrammatic upper perspective view of an embodiment of the present razor cartridge handle.
Figure 4:
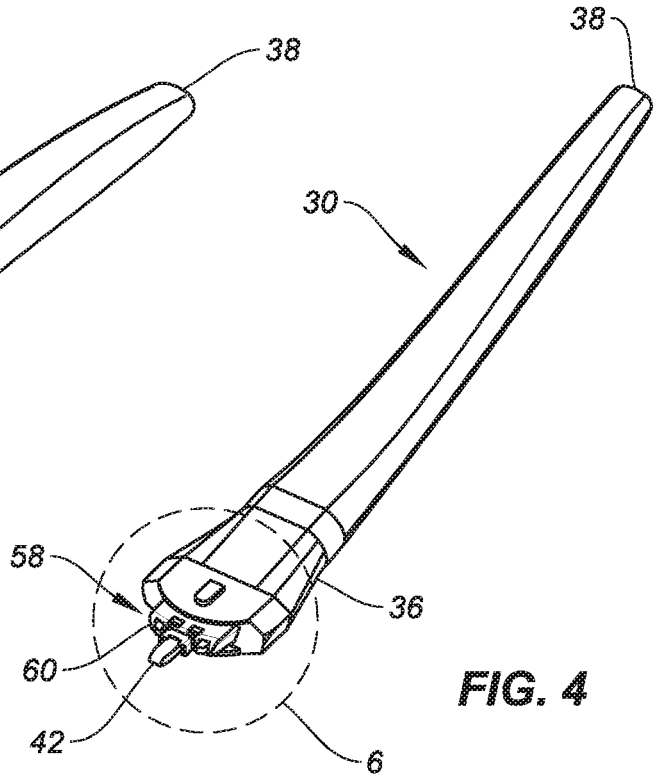
FIG. 4 is a diagrammatic lower perspective view of an embodiment of the present razor cartridge handle.
Figures 5A, 5B, 5C:
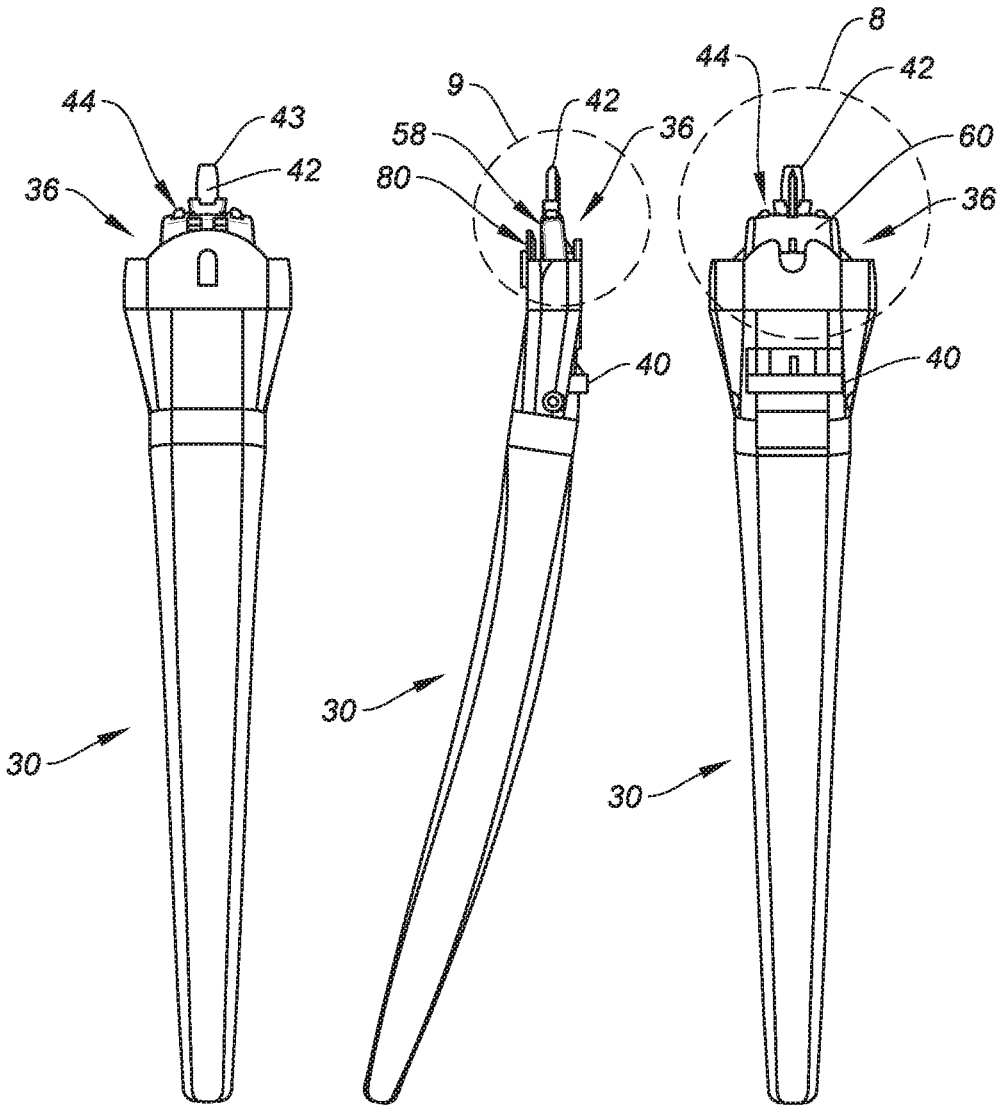
FIG. 5A is a diagrammatic planar view of an embodiment of the present razor cartridge handle, showing the bottom of the handle.
FIG. 5B is a diagrammatic planar view of an embodiment of the present razor cartridge handle, showing a side of the handle.
FIG. 5C is a diagrammatic planar view of an embodiment of the present razor cartridge handle, showing the top of the handle.
Figure 6:
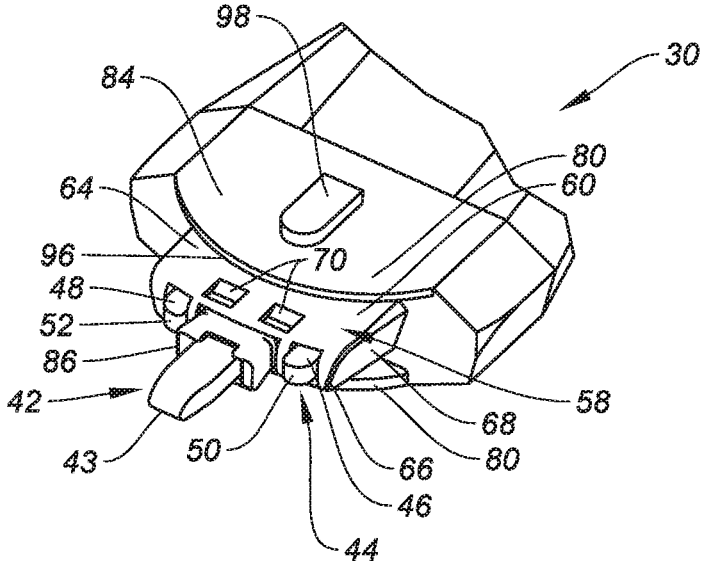
FIG. 6 is an enlarged view of a portion of the present handle shown in FIG. 4.
Figure 7:
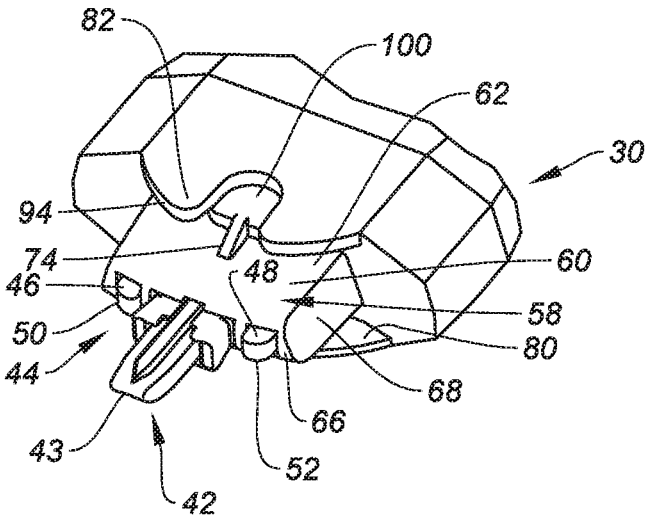
FIG. 7 is an enlarged view of a portion of the present handle shown in FIG. 3.
Figure 8:
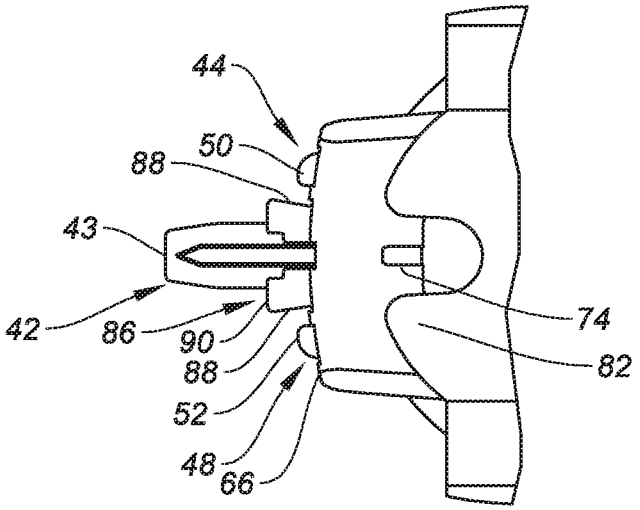
FIG. 8 is an enlarged view of a portion of the present handle shown in FIG. 5C.
Figure 9:
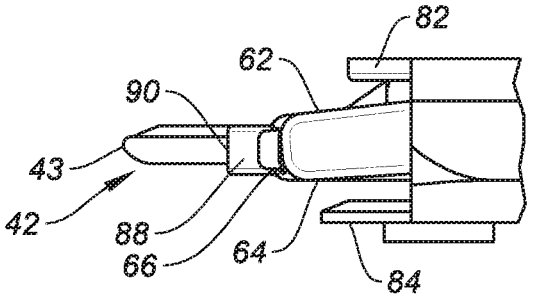
FIG. 9 is an enlarged view of a portion of the present handle shown in FIG. 5B.

The handle 30 includes an ejector button 40 that is normally biased in a first position relative to the handle 30, and is translatable between a normal position (e.g., when a razor cartridge is attached) and a cartridge-eject position. The handle 30 embodiments shown in FIGS. 1 and 3 show the ejector button 40 disposed proximate the cartridge end 36 of the handle 30. The handle 30 is not limited to this embodiment.

Figure 10:
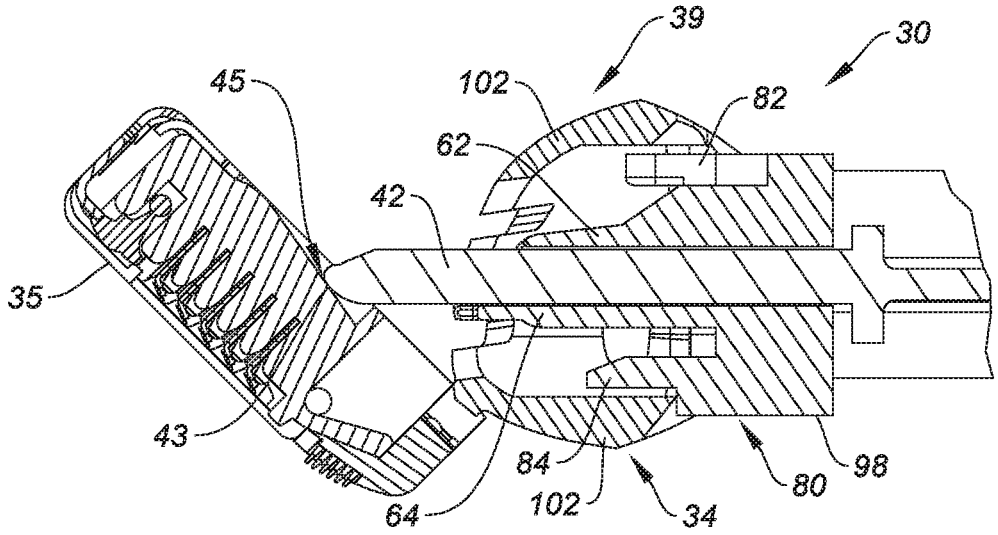
FIG. 10 is a diagrammatic partial cross-sectional view of an embodiment of the present handle, showing a second type razor cartridge attached to the present handle with the cross-section taken through a center plane of the plunger.
Figure 11:
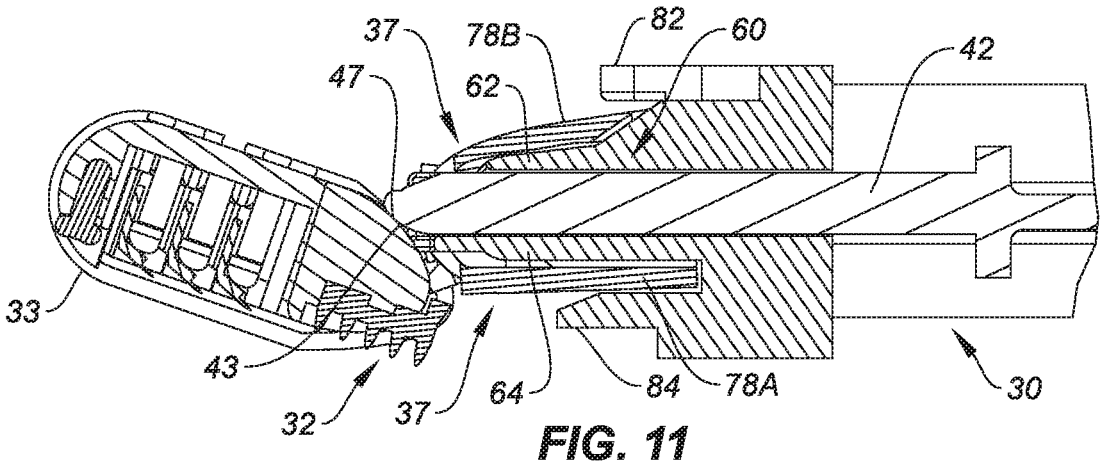
FIG. 11 is a diagrammatic partial cross-sectional view of an embodiment of the present handle, showing a first type razor cartridge attached to the present handle with the cross-section taken through a center plane of the plunger.
Figure 12:
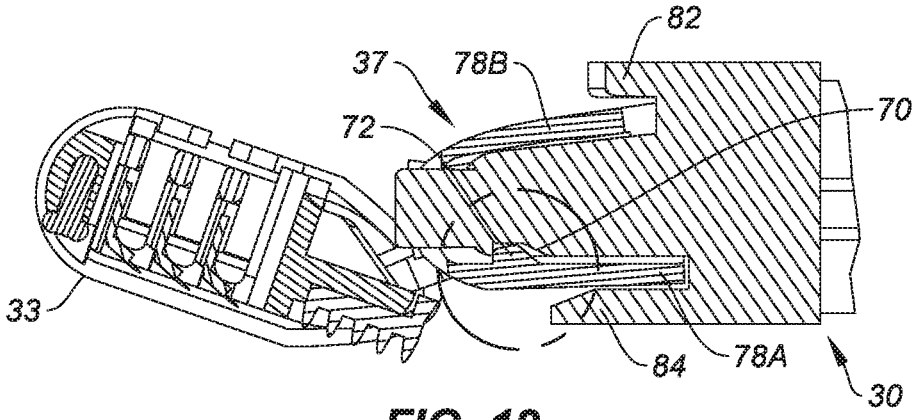
FIG. 12 is a diagrammatic partial cross-sectional view of an embodiment of the present handle, showing a first type razor cartridge attached to the present handle with the cross-section taken through the attachment assembly.

Referring to FIGS. 3-14, the handle 30 includes a plunger 42 that is normally biased (e.g., by a spring) outwardly from the handle cartridge end 36 to reside in an extended position. When a razor cartridge is attached to the handle 30, the plunger 42 engages a cam surface of the razor cartridge blade unit to bias the blade unit to a neutral or at-rest position relative to the handle 30 when forces encountered by the blade unit during shaving are removed. The plunger 42 includes a distal end 43 that is configured to cooperate with both of a cam surface of the blade unit 33 of the first type razor cartridge 32 and with a cam surface of the blade unit 35 of the second type razor cartridge 34; i.e., the present plunger 42 is functional with both types of razor cartridges. As the razor cartridge blade unit rotates away from the neutral position, e.g. under shaving forces, the plunger 42 recedes within the handle 30. The term "cooperate" is used above in this paragraph to mean that the distal end of the plunger 42 engages with the cam surface of the blade unit 33, 35 in a manner that facilitates engagement of the blade unit (e.g., positioning of the blade unit in the intended normally biased position), the axial movement of the plunger 42, and the rotational movement of the blade unit 33, 35, for both types of razor cartridges. FIG. 10 shows a cross-sectional view of an embodiment of the present handle 30 with a second type razor cartridge 34 attached to the handle 30, illustrating the plunger 42 disposed in a normally biased position with its distal end 43 engaged with a cam surface 45 on the blade unit 35 of the second type razor cartridge 34. FIG. 11 shows a cross-sectional view of an embodiment of the present handle 30 with a first type razor cartridge 32 attached to the handle 30, illustrating the plunger 42 disposed in a normally biased position with its distal end 43 engaged with a cam surface 47 on the blade unit 33 of the first type razor cartridge 32.

Figure 13:
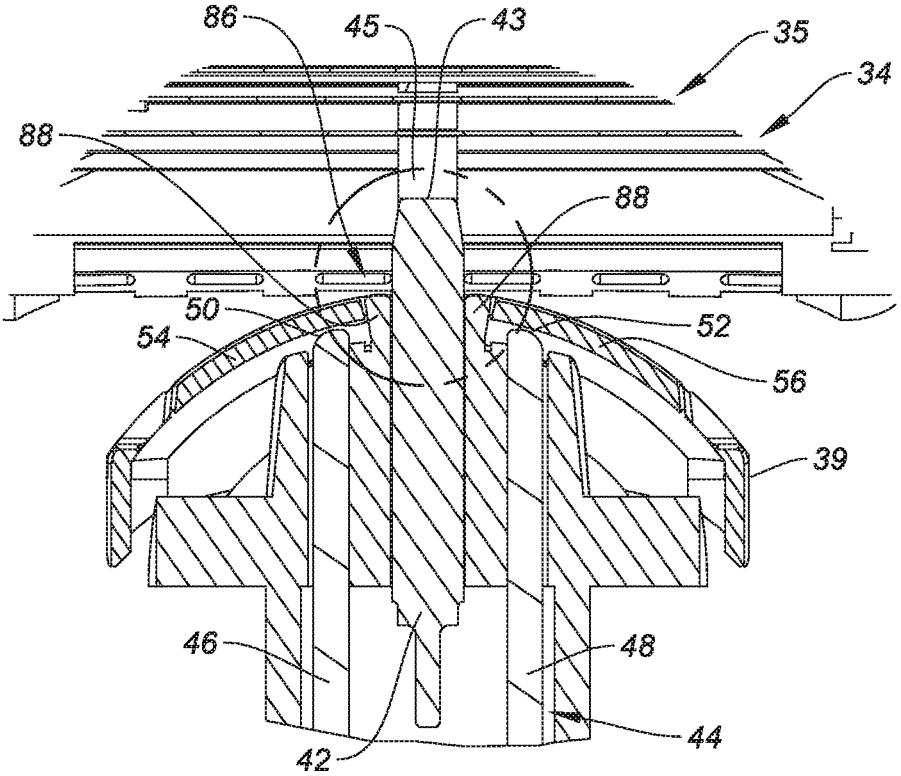
FIG. 13 is a diagrammatic partial cross-sectional view of an embodiment of the present handle, showing a second type razor cartridge attached to the present handle.
Figure 14:
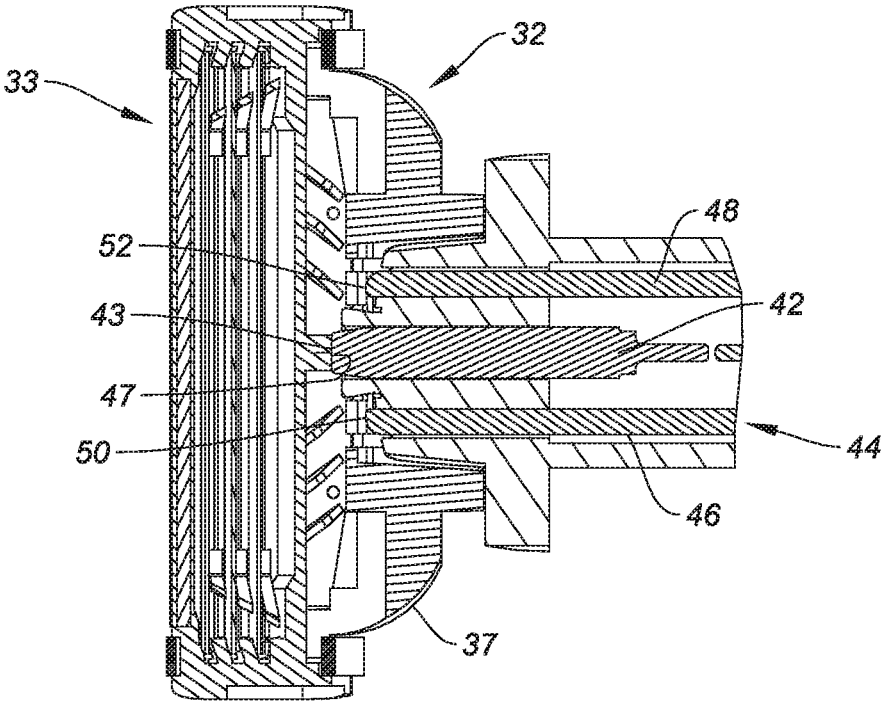
FIG. 14 is a diagrammatic partial cross-sectional view of an embodiment of the present handle, showing a first type razor cartridge attached to the present handle.

The handle 30 includes an ejector 44 having a first arm 46 and a second arm 48 (e.g., see FIGS. 6, 7, 13, 14). The first arm 46 includes a distal end 50 and the second arm includes a distal end 52. The ejector 44 is normally biased (e.g., by a spring) in a retracted position wherein the arms 46, 48 substantially reside within the handle 30. The ejector 44 is in communication with the ejector button 40 (e.g., see FIG. 5C) such that translating the ejector button 40 to the cartridge-eject position causes the ejector arms 46, 48 to extend outwardly from the handle cartridge end 36, and causes the distal ends 50, 52 of the ejector arms 46, 48 to contact the attached razor cartridge. FIG. 13, for example, shows a partial cross-sectional view of a second type razor cartridge 34 attached to an embodiment of the present handle 30. In the view shown in FIG. 13, the ejector arms 46, 48 are shown in the retracted position and it can be seen that the distal end 50, 52 of each ejector arm 46, 48 is aligned with a cantilevered latch 54, 56 that forms a part of the end wall of the second type razor cartridge connecting member 39 (a further description of the second type razor cartridge connecting member 39 is provided below). FIG. 14 shows a partial cross-sectional view of a first type razor cartridge 32 attached to an embodiment of the present handle 30. In the view shown in FIG. 14, the ejector arms 46, 48 are shown in the retracted position and it can be seen that the distal end 50, 52 of each ejector arm 46, 48 is aligned with a feature of the first type razor cartridge connecting member 37 (a further description of the first type razor cartridge connecting member 37 is provided below).

It can be seen from above, therefore, that the distal ends 50, 52 of the ejector arms 46, 48 are configured to cooperate with features of the connecting member 37 of the first type razor cartridge 32 and also with features of the connecting member 39 of the second type razor cartridge 34 to allow the respective type razor cartridge 32, 34 to be removed from the present razor cartridge handle 30; i.e., the present ejector arms 46, 48 are functional with both types of razor cartridges 32, 34. The term "cooperate" is used above in this paragraph to mean that the distal ends 50, 52 of the ejector arms 46, 48 are configured in a manner that facilitates engagement of the features of the respective connecting member 37, 39 of both types of razor cartridges to allow that type razor cartridge to be removed from the present razor cartridge handle 30.

Referring to FIGS. 3-9, the handle 30 includes a first assembly 58 configured to connect the handle 30 to a first type razor cartridge 32. The first assembly 58 includes a body 60 extending out from cartridge end 36 of the handle 30. The body 60 is configured to be received within a first type of razor cartridge. As can be seen in FIGS. 6-9, 14, and 15, the body 60 is a male projection that is configured to be received in a mating female cavity portion of the first type razor cartridge connecting member 37; the mating male projection and the female cavity can be referred to as the "connecting pair". The body 60 includes a top panel 62 spaced apart from an opposing bottom panel 64, an end panel 66, and a pair of side panels 68. The end panel 66 and side panels 68 extend between the top and bottom panels 62, 64. The bottom panel 64 includes a pair of tab slots 70 positioned to receive tabs 72 attached to the first type razor cartridge 32 (e.g., see FIGS. 12, 16; as described below). The plunger 42 and ejector arms 46, 48 are disposed between the top and bottom panels 62, 64; e.g., in the normally biased position, the ejector arms 46, 48 substantially reside within the body 60 portion of the handle 30. The first assembly 58 further includes a ramp tab 74 (e.g., see FIGS. 7-9) extending out from the top panel 62. The ramp tab 74 is configured and positioned to engage a tab retainer portion of a cartridge dispenser (not shown) used to house replacement first type razor cartridges 32; e.g., when the handle 30 is moved to engage a replacement cartridge disposed within the dispenser, the ramp tab 74 displaces the tab retainer thereby enabling the handle 30 to connect with the replacement razor cartridge.

Figure 15:
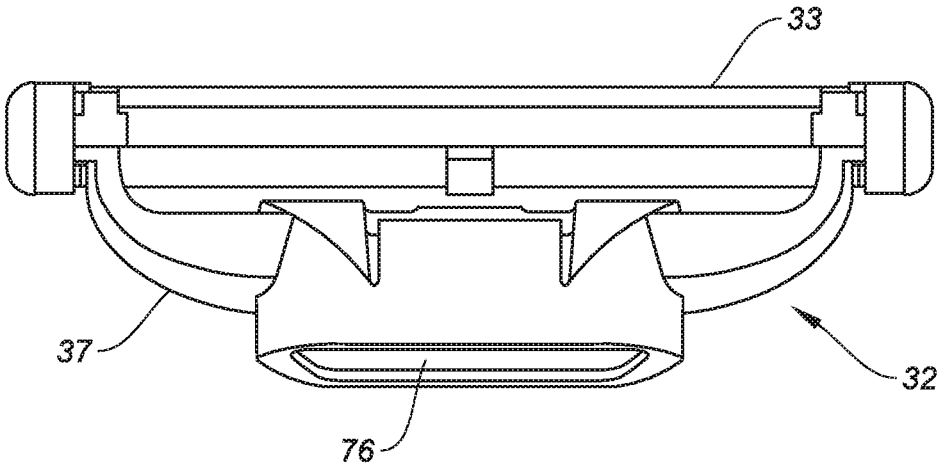
FIG. 15 (Prior Art)
FIG. 15 is a planar view of a first type razor cartridge.
Figure 16:
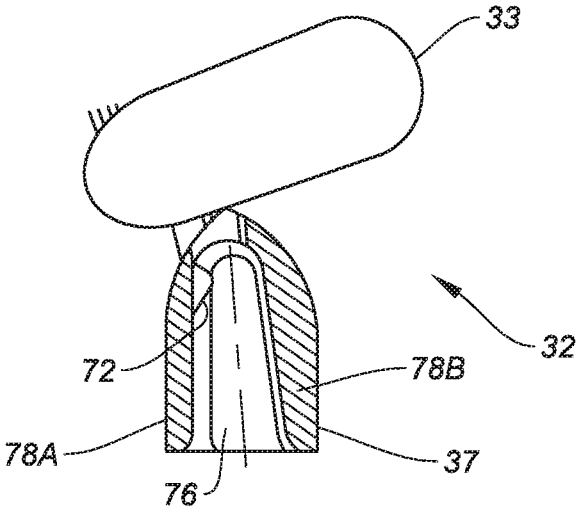
FIG. 16 (Prior Art)
FIG. 16 is a partial cross-sectional side view of a first type razor cartridge.

To provide a full understanding of the first assembly 58, it is useful to briefly describe some aspects of the first type razor cartridge 32. FIGS. 15 and 16 show views of a first type razor cartridge 32, which cartridge includes a blade unit 33 pivotally attached to a connecting member 37. The connecting member 37 includes a cavity 76 (i.e., the female member of the connecting pair referenced above) formed in part by a pair of side walls 78A, 78B. The cavity 76 is configured to receive the body 60 (i.e., the male projection of the connecting pair) of the present handle first assembly 58. The connecting member 37 includes a pair of tabs 72 configured to engage the tab slots 70 disposed in the body bottom panel 64.

Referring to FIGS. 6-12, as indicated above the ejector 44 of the present razor cartridge handle 30 is translatable between the normal position and the cartridge-eject position. When a first type razor cartridge 32 is attached to the present handle 30 and the ejector 44 is in the normal position, the connecting member tabs 72 are engaged with the tab slots 70 disposed in the body 60 (e.g., see FIG. 12), thereby preventing the cartridge 32 from being dislodged from the handle 30 during normal operation. As will be further explained below, the present handle 30 includes a second assembly 80 having a top locating panel 82 spaced apart from the body top panel 62 and a bottom locating panel 84 spaced apart from the body bottom panel 64. When a first type razor cartridge 32 is attached to the handle 30, one of the side walls 78A, 78B of the first type razor cartridge connecting member 37 is disposed in a gap between the top locating panel 82 and the body top panel 62, and the other side wall 78B, 78A is disposed in a gap between the bottom locating panel 84 and the body bottom panel 64. The ejector arms 46, 48 are configured to engage features disposed in the first type razor cartridge 32. When the ejector 44 is translated into the cartridge-eject position, the ejector arms 46, 48 engage the features, causing them and the attached tabs 72 to deflect and disengage the tabs 72 from the tab slots 70 within the body bottom panel 64, thereby permitting the razor cartridge 32 to be removed from the handle 30.

The second assembly 80 is configured to connect the handle 30 to a second type razor cartridge 34. The second assembly 80 includes a wedge-shaped projection 86 extending outwardly from the body end panel 66 (e.g., see FIGS. 8, 9, and 13). The projection 86 includes a pair of side walls 88 and an end wall 90, which side walls 88 extend from the end wall 90 to the body end panel 66, which side walls 88 converge toward one another in the direction of the body end panel 66. The wedge-shaped projection 86 can be described as having a large distal end (at the end wall 90) and a relatively smaller end (at the body end panel 66). As indicated above, the second assembly 80 further includes a top locating panel 82 spaced apart from the body top panel 62 (i.e., a gap separates the top locating panel 82 from the body top panel 62), and a bottom locating panel 84 spaced apart from the body bottom panel 64 (i.e., a gap separates the bottom locating panel 84 from the body bottom panel 64); e.g., see FIG. 10. As will be explained below, the top and bottom locating panels 82, 84 are configured to be received within a cavity 92 disposed in a connecting member 39 of the second type razor cartridge 34 (e.g., see FIG. 10). The top locating panel 82 has a distal edge 94 that is arcuately shaped to mate with the cavity of the second type razor cartridge 34. The bottom locating panel 84 also has a distal edge 96 that is arcuately shaped to mate with the cavity of the second type razor cartridge 34. In the embodiments shown, for example, in FIGS. 6 and 7, the curvature of the distal edges 94, 96 of the top and bottom locating panels 82, 84 differ from one another. The second assembly 80 further includes a projection 98 extending out from the bottom locating panel 84, which projection 98 is positioned to engage an edge of the second type razor cartridge connecting member 39 to inhibit movement between the second type razor cartridge 34 and the handle 30. The top locating panel 82 includes a slot 100 (e.g., see FIG. 8) configured to receive the tab retainer portion of the cartridge dispenser (not shown) used to house replacement first type razor cartridges 32.

Figure 17:
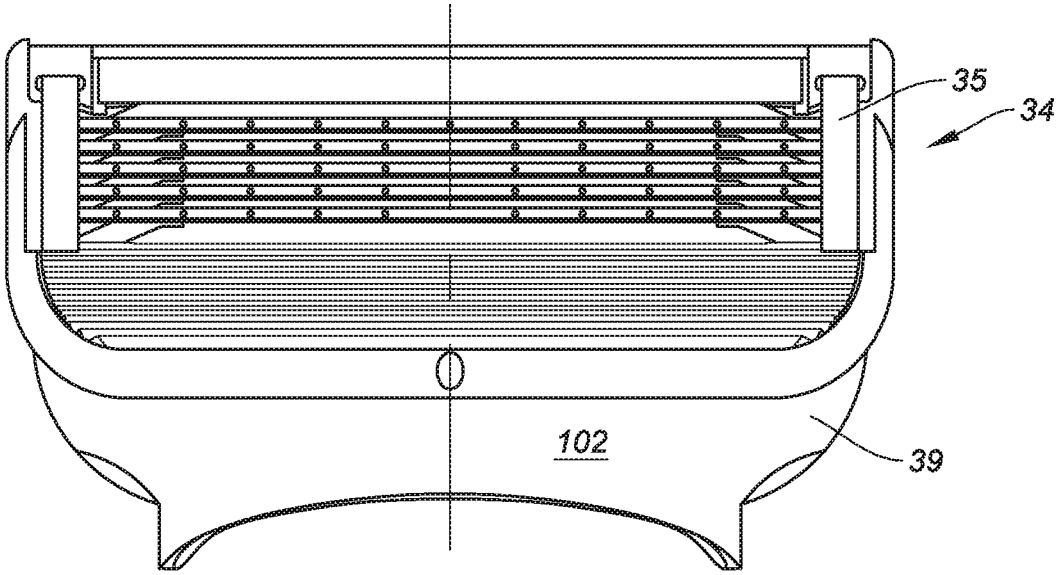
FIG. 17 (Prior Art)
FIG. 17 is a front planar view of a second type razor cartridge.
Figure 18:
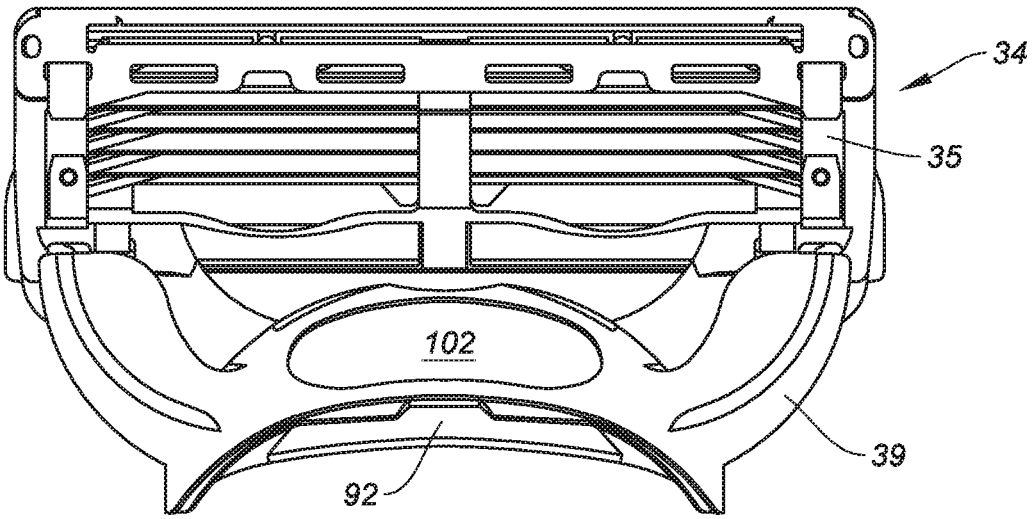
FIG. 18 (Prior Art)
FIG. 18 is a rear planar view of a second type razor cartridge.
Figure 19:
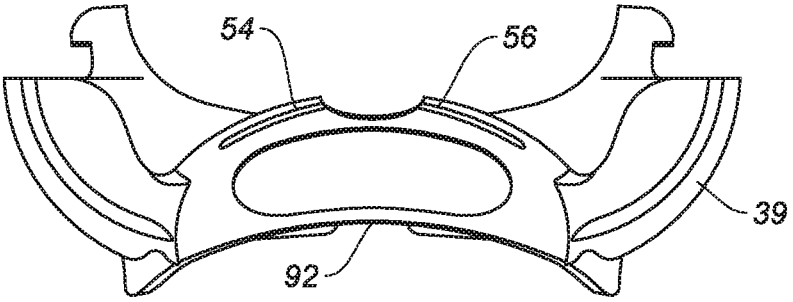
FIG. 19 (Prior Art)
FIG. 19 is a front planar view of the connecting member of a second type razor cartridge.
Figure 20:
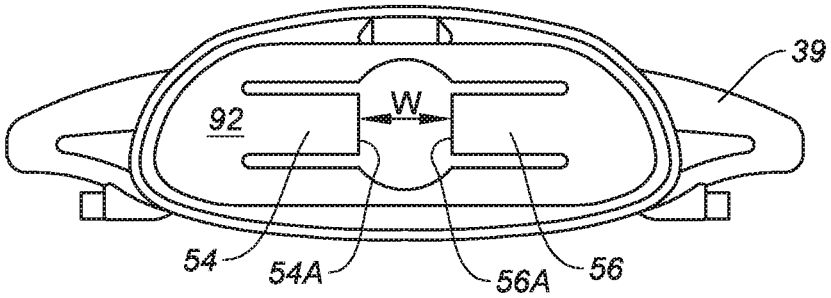
FIG. 20 (Prior Art)
FIG. 20 is a bottom planar view of the connecting member of a second type razor cartridge.

To provide a full understanding of the second assembly 80, it is useful to briefly describe some aspects of the second type razor cartridge 34. FIGS. 17 and 18 show front and rear views of a second type razor cartridge 34, respectively. FIGS. 19 and 20 show front and bottom views of the connecting member 39 of a second type razor cartridge 34, respectively. As indicated above, the second type razor cartridge 34 includes a blade unit 35 pivotally attached to a connecting member 39. The connecting member 39 includes a body having a cavity 92 partially formed by side walls 102 and an end wall; e.g., see FIG. 10. A pair of cantilevered latches 54, 56 form a part of the end wall. Each cantilevered latch 54, 56 includes a free distal end 54A, 56A (see FIG. 20) that form a portion of an opening extending through end wall, which opening has width "W".

Referring now to FIG. 13, a second type cartridge is partially shown, in diagrammatic fashion, connected to the present handle 30. When the second type razor cartridge 34 and the present handle 30 are attached, the distal ends of the latches 54, 56 of the second type razor cartridge connecting member 39 are engaged with the side walls 88 of the wedge-shaped projection 86. The wedge shape inhibits removal of the second type razor cartridge 34 from the handle 30 during normal operation of the razor.

Referring to FIG. 10, when the second type cartridge is attached to the handle 30, the top and bottom locating panels 82, 84 are received within the cavity 92 disposed in the second razor type connecting member in close proximity to the respective side of the cavity 92 to inhibit relative movement between the handle 30 and the second type razor cartridge 34. The projection 98 extending out from the bottom locating panel 84 engages an edge of the second type razor cartridge connecting member 39, also inhibiting movement between the second type razor cartridge 34 and the handle 30.

As indicated above, the ejector 44 (i.e., the same ejector 44 operable to disengage the first type razor cartridge 32) is translatable between the normal position and the cartridge-eject position. The ejector arms 46, 48 are configured to engage the cantilevered latches 54, 56 portion of the connecting member 39. When the ejector 44 is translated into the cartridge-eject position, the ejector arms 46, 48 engage the cantilevered latches 54, 56, causing them to deflect out of engagement with the wedge-shaped projection 86, thereby permitting removal of the second type razor cartridge 34 from the handle 30.

Figure 21:
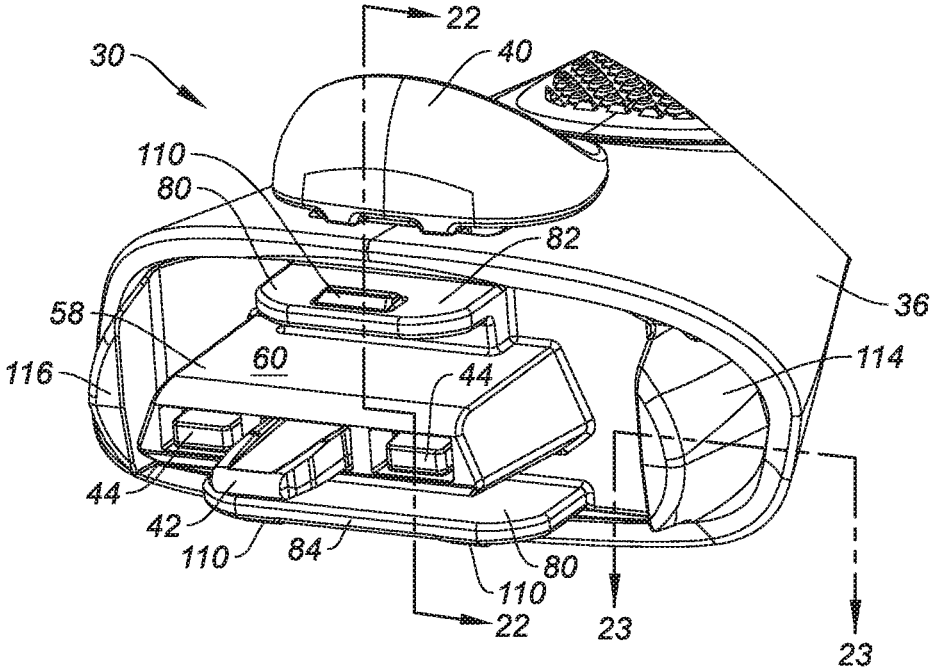
FIG. 21 is a partial diagrammatic perspective view of another embodiment of the present razor cartridge handle.
Figure 22:
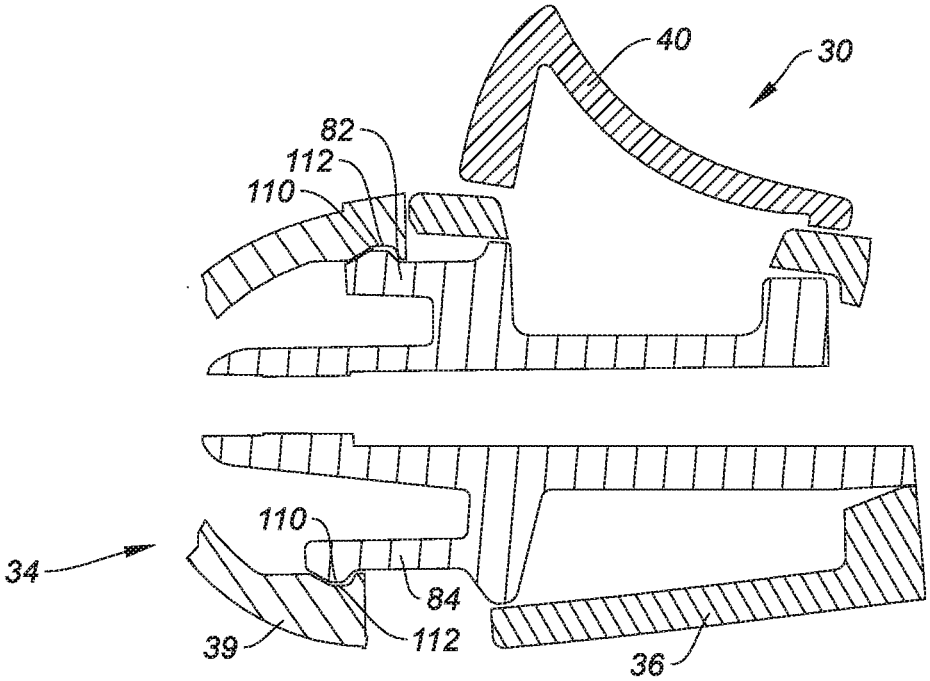
FIG. 22 is a partial cross sectional side view of FIG. 21 showing a portion of the connecting member of the second type of razor cartridge attached to the handle.

Referring to FIG. 21, a partial diagrammatic perspective view of another embodiment of the present razor cartridge handle 30 showing the cartridge end 36 of the handle 30 is shown. This embodiment includes an ejector button 40; plunger 42 and ejector 44 as previously described. This embodiment further includes a first assembly 58 configured to connect the handle 30 to a first type of razor cartridge 32 (not shown), as previously described. This embodiment also includes a second assembly 80 configured to connect the handle 30 to a second type of razor cartridge 34 (not shown). The second assembly comprises top locating panel 82 and bottom locating panel 84. In this embodiment one or both of the top and bottom locating panels 82, 84 are provided with a tab 110. The tab is outwardly extending from any locating panel as shown. FIG. 22 is a partial cross sectional side view of FIG. 21 showing a portion of the connecting member 39 of the second type of razor cartridge 34 attached to the handle 30 (and with the plunger 42 and ejector 44 omitted for clarity). As depicted, both top locating panel 82 and bottom locating panel 84 are provided with tabs 110. The connecting member 39 is provided with tab slots 112 to receive the tabs 110 to thereby attach the second type of razor cartridge 34 to the handle 30.

Figure 23:
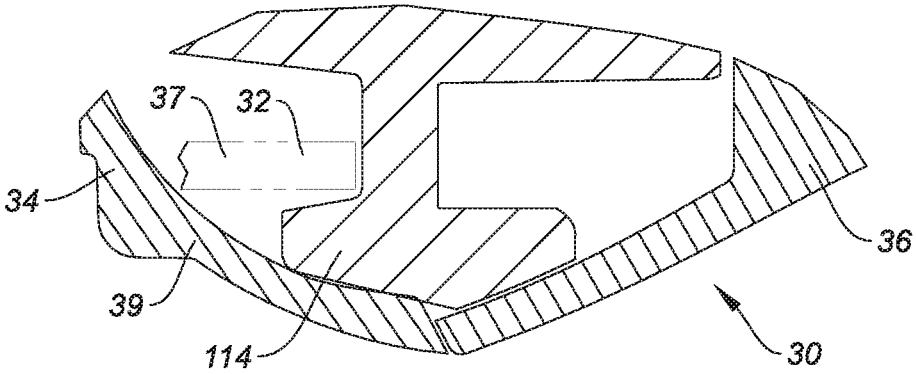
FIG. 23 is a partial diagrammatic cross sectional top view of FIG. 21 showing fragments of the connecting members of the first and the second type of razor cartridges attached to the handle.

In FIG. 21, the handle 30 is provided with laterally opposed stabilizing projections 114, 116. FIG. 23 is a partial diagrammatic or schematic cross sectional top view of FIG. 21 showing fragments of the connecting members 37, 39 of the first and the second type of razor cartridges 32, 34 attached to the handle 30 simultaneously, only for the purposes of illustration (the connecting member 37 of the first type of razor cartridge being shown in chain dotted line). Stabilizing projections 114 and 116 are alternately intended to fit within the connecting member 39 of the second type of razor cartridge 34 or external to the connecting member 37 of the first type of razor cartridge 32 to provide guidance as a user attaches either type of razor cartridge to the handle and to provide resistance against either type of razor cartridge rocking from side to side (clockwise/counter clockwise as depicted in the plane of FIG. 23), or laterally, relative to the handle 30.

It can be seen from above, that the present handle 30 includes an ejector button 40, an ejector 44, and a plunger 42 all adapted to operate with both a first type razor cartridge 32 and a second type razor cartridge 34; e.g., the plunger 42 is operable to bias the aft portion of both type razor cartridges 32, 34 to rotate away from the handle 30, and the ejector 44 and ejector button 40 can be actuated to disengage both types of razor cartridges 32, 34 from the handle 30. Consequently, the present handle 30 makes it possible to use a plurality of different type razor cartridges with a single handle (without the expense or need for an adapter independent of the handle), thereby greatly increasing the versatility of the handle without impairing the operation of either type razor cartridge.

Those skilled in the art will recognize that variations and modifications can be made without departing from the true scope of the disclosure as defined by the claims that follow. For instance, features disclosed in connection with any one embodiment can be used alone or in combination with each feature of the respective other embodiments.

What is claimed is:

1. A combination of a safety razor handle and a razor cartridge, comprising:

a razor cartridge handle configured to be connected to a first type razor cartridge having a first type razor cartridge connecting member, and configured to be connected to a second type razor cartridge having a second type razor cartridge connecting member, wherein the first type razor cartridge connecting member is different from the second type razor cartridge connecting member, the handle comprising:

a cartridge end and an opposed end;

a first group of panels at the cartridge end configured to connect the first type razor cartridge connecting member to the cartridge end of the handle, the first group of panels including a body extending outwardly from the cartridge end of the handle, the body including a body first panel spaced apart from an opposing body second panel, and an end panel extending between the body first and second panels;

a second group of panels at the cartridge end configured to connect the second type razor cartridge connecting member to the cartridge end of the handle, the second group of panels including a first locating panel spaced apart from the body first panel;

wherein the first and second groups of panels are configured so that only a single razor cartridge can be attached to the handle at a time, the razor cartridge being either a first type razor cartridge or a second type razor cartridge; and the first type razor cartridge connected to the handle such that the body is received within a cavity of the first type razor cartridge connecting member and a first side wall of the connecting member is received in a gap between the first locating panel and the body first panel.

2. The combination of claim 1, wherein the second group of panels includes a second locating panel spaced apart from the body second panel and a second side wall of the connecting member is received in a gap between the second locating panel and the body second panel.

3. The combination of claim 1, wherein the handle further comprises an ejector button at the cartridge end of the handle that is configured to be biased in a first position relative to the handle, and is translatable to an eject position and an ejector having a first arm with a distal end and a second arm with a distal end, the ejector arms being substantially disposed between the body first and body second panels, the ejector being configured to be biased in a retracted position;

wherein the ejector is in communication with the ejector button such that translating the ejector button to the eject position causes the ejector arms to extend outwardly from the handle cartridge end and causes the distal ends of the ejector arms to contact the first type razor cartridge.

4. The combination of claim 1, wherein the handle further comprises a plunger with a distal end, the plunger being configured to be biased outwardly from the handle cartridge end to reside in an extended position;

wherein in the extended position the distal end of the plunger is in contact with the first type razor cartridge; and wherein the plunger is substantially disposed between the body first and second panels.

5. The combination of claim 4, wherein the distal end of the plunger engages a surface of a blade unit of the first type of razor cartridge.

6. The combination of claim 1, wherein the cartridge end of the handle further comprises laterally opposed stabilizing projections disposed externally of the first type razor cartridge connecting member.

7. The combination of claim 1, wherein a second side wall of the first type razor cartridge connecting member opposed the first side wall includes a pair of tabs engaged in a one of a respective pair of tab slots the body second panel.

8. A combination of a safety razor handle and a razor cartridge, comprising:

a razor cartridge handle configured to be connected to a first type razor cartridge having a first type razor cartridge connecting member, and configured to be connected to a second, type razor cartridge having a second type razor cartridge connecting member, wherein the first type razor cartridge connecting member is different from the second type razor cartridge connecting member, the handle comprising:

a cartridge end and an opposed end, a first group of panels at the cartridge end configured to connect the first type razor cartridge connecting member to the cartridge end of the handle, the first group of panels including a body extending outwardly from the cartridge end of the handle, the body including a body first panel spaced apart from an opposing body second panel, and an end panel extending between the body first and second panels, a second group of panels at the cartridge end configured to connect the second type razor cartridge connecting member to the cartridge end of the handle, the second group of panels including a first locating panel spaced apart from the body first panel;

wherein the first and second groups of panels are configured so that only a single razor cartridge can be attached to the handle at a time, the razor cartridge being either a first type razor cartridge or a second type razor cartridge; and the second type razor cartridge connected to the handle such that the first locating panel is received within a cavity of the second type razor cartridge connecting member.

9. The combination of claim 8, wherein the second group of panels includes a second locating panel and the second locating panel is received within the cavity of second type razor cartridge connecting member.

10. The combination of claim 8, wherein the second group of panels includes a second locating panel and at least one of the first and the second locating panels includes an outwardly extending tab and the tab is received in a respective tab slot of the second type razor cartridge connecting member.

11. The combination of claim 8, wherein the handle further comprises an ejector button at the cartridge end of the handle that is configured to be biased in a first position relative to the handle, and is translatable to an eject position and an ejector having a first arm with a distal end and a second arm with a distal end the ejector arms being substantially disposed between the body first and body second panels, the ejector being configured to be biased in a retracted position wherein the arms substantially reside within the handle;

wherein the ejector is in communication with the ejector button such that translating the ejector button to the eject position causes the ejector arms to extend outwardly from the handle cartridge end and causes the distal ends of the ejector arms to contact the second type razor cartridge.

12. The combination of claim 8, wherein the handle further comprises a plunger with a distal end, the plunger being configured to be biased outwardly from the handle cartridge end to reside in an extended position, wherein in the extended position the distal end of the plunger is in contact with the second type razor cartridge; and wherein the plunger is substantially disposed between the body first and second panels.

13. The combination of claim 12, wherein the distal end of the plunger engages a surface of a blade unit of the second type of razor cartridge.

14. The combination of claim 8, wherein the cartridge end of the handle further comprises laterally opposed stabilizing projections received within the cavity of the second type razor cartridge connecting member.

15. The combination of claim 8, wherein the body further includes a wedge-shaped projection extending outwardly from the body end panel, the projection including a pair of side walls and an end wall, and the side walls converge toward one another in a direction of the body end panel.

* * * * *